US009511902B2

(12) United States Patent
Le Talludec

(10) Patent No.: US 9,511,902 B2
(45) Date of Patent: Dec. 6, 2016

(54) CAN-SHAPED CONTAINER HAVING A PROTECTIVE INNER LAYER

(75) Inventor: Alain Le Talludec, Durtal (FR)

(73) Assignee: ARDAGH MP GROUP NETHERLANDS B.V., Deventer (NL)

( * ) Notice: Subject to any disclaimer, the term of this patent is extended or adjusted under 35 U.S.C. 154(b) by 1207 days.

(21) Appl. No.: 13/516,849

(22) PCT Filed: Dec. 16, 2010

(86) PCT No.: PCT/FR2010/052769
§ 371 (c)(1),
(2), (4) Date: Jun. 18, 2012

(87) PCT Pub. No.: WO2011/073583
PCT Pub. Date: Jun. 23, 2011

(65) Prior Publication Data

US 2012/0255262 A1 Oct. 11, 2012

(30) Foreign Application Priority Data

Dec. 17, 2009 (FR) ..... 09 06114

(51) Int. Cl.
*B65D 6/14* (2006.01)
*B65D 25/14* (2006.01)
(Continued)

(52) U.S. Cl.
CPC ..... *B65D 25/14* (2013.01); *B65D 1/28* (2013.01); *C23C 28/00* (2013.01)

(58) Field of Classification Search
CPC ..... B65D 25/14; B65D 1/28; C23C 28/00
(Continued)

(56) References Cited

U.S. PATENT DOCUMENTS 1,622,533 A * 3/1927 Murch ..... B65D 25/14 220/62.13
1,811,160 A 6/1931 Stevenson
(Continued)

FOREIGN PATENT DOCUMENTS

EP 0 447 563 A1 9/1991
EP 0 492 870 A1 7/1992
(Continued)

OTHER PUBLICATIONS

International Search Report, dated Mar. 23, 2011, from corresponding PCT application.

*Primary Examiner* — Jacob K Ackun
*Assistant Examiner* — Jenine Pagan
(74) *Attorney, Agent, or Firm* — Young & Thompson

(57) ABSTRACT

A container such as a can for holding a product to be packaged, in particular a food item, includes a can body (1) made up of a bottom element (2) which is extended by a side wall (3), the can body (1) defining an inner packaging space (6) and including an inner surface (7) made at least partially of tin, which is covered with a protective layer (10) intended for resisting the chemical activity of the product to be packaged. The protective layer (10) includes, distributed over at least one portion of the surface thereof, a plurality of pores (11) through each one of which an area (7*a*) opposite the tin inner surface (7) can be accessed from the inner container space (6), in particular to allow the release of tin while minimizing the aesthetic impact caused by the chemical activity of the product to be packaged on the tin inner surface (7).

10 Claims, 1 Drawing Sheet

(51) Int. Cl.
*B65D 1/28* (2006.01)
*C23C 28/00* (2006.01)

(58) Field of Classification Search
USPC .... 220/62.13, 917; 206/524.3; 426/131, 133
See application file for complete search history.

(56) References Cited

U.S. PATENT DOCUMENTS 1,830,244 A * 11/1931 Richardson ..... B65D 25/14 220/62.13
1,958,765 A * 5/1934 Perkins ..... C23F 13/02 204/196.17
2,071,602 A * 2/1937 Rheem ..... B65D 25/14 220/619
2,875,071 A * 2/1959 Malecki ..... A23B 7/00 426/127
3,219,729 A * 11/1965 Meyers ..... C09D 127/06 220/62.11
3,265,239 A * 8/1966 Raymond ..... B65D 25/14 205/112
3,687,334 A * 8/1972 McNeil ..... B65D 43/0222 220/795
3,888,224 A * 6/1975 Okuhara ..... A23L 3/358 220/62.11
4,055,272 A * 10/1977 Beese ..... B65D 25/14 205/226
4,452,375 A * 6/1984 Marcus ..... B65D 25/14 220/62.12
5,202,013 A * 4/1993 Chamberlain ..... C25D 11/18 205/120

FOREIGN PATENT DOCUMENTS

EP 0 688 615 A1 12/1995
EP 2 082 968 A1 7/2009
JP 03256852 11/1991
JP 2002172869 6/2002
JP 2008074461 4/2008

* cited by examiner

CAN-SHAPED CONTAINER HAVING A PROTECTIVE INNER LAYER

The present invention relates to a container of the can type, intended to receive a product to be packaged, and the inner surface of which is at least partially consisted of tin covered with a protective layer.

Certain food items, such as fruits or products containing tomato, are advantageously packaged in cans having a can body whose inner surface is at least partially consisted of tin.

Indeed, thus packaged, the product picks up a certain amount of tin from the inner surface of the can body, which ensures the preservation of the organoleptic and visual properties thereof by limiting, or even eliminating, the oxidation phenomena.

To control the amount of tin made available to the packaged product, it is known to partially coat the tinned inner surface of the can body with a layer of protective lacquer.

Such cans partially lacquered inside are, for example, described in the documents EP-0 492 870 or EP-0 688 615.

In these documents, the can body, comprising a bottom element that is continued by a side wall whose upper edge delimits an upper opening intended to receive a sealing element, is made from a plate of tin shaped by a drawing operation.

The body of such can comprises a single lacquered cylindrical surface, which extends continuously and uniformly over a portion of height of the inner surface of the side wall thereof, from the upper edge thereof. The remaining cylindrical portion of height of this side wall (herein toward the bottom element thereof) forms an exposed area of the tin inner surface (devoid of a protective layer).

The tin picking up has a clear interest for the packaged product, but the contact between the product and the tinned surface of the can body causes a corrosion reaction that comes with a slight darkening phenomenon.

Therefore, the above-mentioned type of partially lacquered can is not fully satisfactory in that the inner surface of the side wall thereof shows a contrast with two areas of different colors that reveal not much aesthetically pleasing (the upper lacquered area is rather clear, and the other, lower area, without lacquer, is darker).

Considering this drawback, the applicant has developed a new can-type container, particularly adapted for the packaging of food items, the tin inner surface of which is coated with a protective layer that is adapted to limit, or even eliminate, the aesthetic impact of the chemical reaction of the product with the exposed tin, while permitting an optimum availability of the tin to preserve the qualitative characteristics of the packaged food item. More generally, such a container may be used for packaging any product for which it would be interesting to pick up tin directly from the can body.

For that purpose, the container according to the invention comprises a can body (for example in one or two parts) delimiting an inner packaging volume and having an inner surface at least partially consisted of tin covered with a protective layer intended to resist to the chemical action of the product to be packaged.

Said container is characterized in that said protective layer has, distributed over at least a portion of its surface, a plurality of pores (or, in other words, of orifices or openings) through each of which an opposite area of the tin inner surface can be accessed from the inner packaging volume.

Therefore, this particular can provides the division of the exposed tin inner surface (accessible through the pores) into a plurality or multiplicity of distinct areas; this allows the distribution of the desired exposed tinned surface over a more important portion of the inner packaging surface, and thus to limit the visual impact resulting from the chemical reaction between the tin and the packaged product.

Other advantageous structural characteristics, which can be considered alone or in combination, are developed hereinafter:

- the pores of the protective layer are uniformly or at least approximately uniformly distributed over the tin inner surface; as an alternative, they may be grouped on a portion of the tin inner surface, for example within the width of a strip located on the side wall, preferably remote from the upper edge and under the surface level of the products intended to be packaged in the can body, so as to obtain an upper strip of said side wall provided with a uniform protective layer, devoid of such pores;
- the pores of the protective layer are arranged randomly or non-randomly, in all or part of the protective layer;
- the pores of the protective layer have a maximum size greater than 0.1 μm, and preferably smaller than 5 mm;
- the pores of the protective layer have preferably a surface area comprised between 100 $\mu m^2$ and 9 $mm^2$ (or still advantageously between 2 and 9 $mm^2$);
- the pores of the protective layer represent together a surface area comprised between 10% and 70%, and still preferably between 17% and 50%, with respect to the inner surface of the can body;
- the protective layer consists of a protective lacquer, chosen for example from the polyester and the epoxy-acrylate, and advantageously comprising a thickness comprised between 2 and 80 μm (and preferably between 4 and 30 μm);
- as an alternative, this protective layer consists of an integral protective film conforming the inner surface of the can body, wherein said protective film has a resistance to elongation that is lower than that of the metal material of which said can body is made.

The invention also relates to a method of manufacturing the above-described container, said method comprising, before the step of filling with the product to be packaged, a step of obtaining the protective layer including, distributed over at least a portion of its surface, a plurality of pores through each of which an opposite area of the tin inner surface can be accessed from the container inner volume.

According to a particular embodiment, the protective layer consists of a protective lacquer that is applied on the tin inner surface so as to obtain the protective layer with the pores for access to said tinned inner surface.

This protective lacquer layer is advantageously applied (i) on a metal part intended to be shaped so as to form at least a portion of the can body and/or (ii) on a metal part already shaped.

The applied protective lacquer advantageously consists of an emulsion or a dispersion comprising (i) the actual protective lacquer and (ii) a fluid dispersed within said lacquer and that is capable of being eliminated after the operation of application on the can body, so as to form the pores.

The fluid dispersed within the lacquer consists, for example, of a liquid intended to be eliminated by natural or active evaporation.

According to another embodiment, the method comprises, before the step of filling:

- a step of providing at least one metal part intended to be shaped to form at least a portion of the container can body, said metal part being covered with a protective film (a laminated film or a lacquer layer, for example) intended to form the protective layer and having a resistance to elongation that is lower than that of the metal material of which said metal part is made, and a step of shaping said metal part to form at least a portion of said container can body, said shaping operation causing an elongation of said metal part, which forms the pores in said protective film by tearing the latter.

The invention will be further illustrated, without being limited in any way, by the following description of a particular embodiment, given only by way of example, illustrated by the appended drawings, in which.

Figure 1:
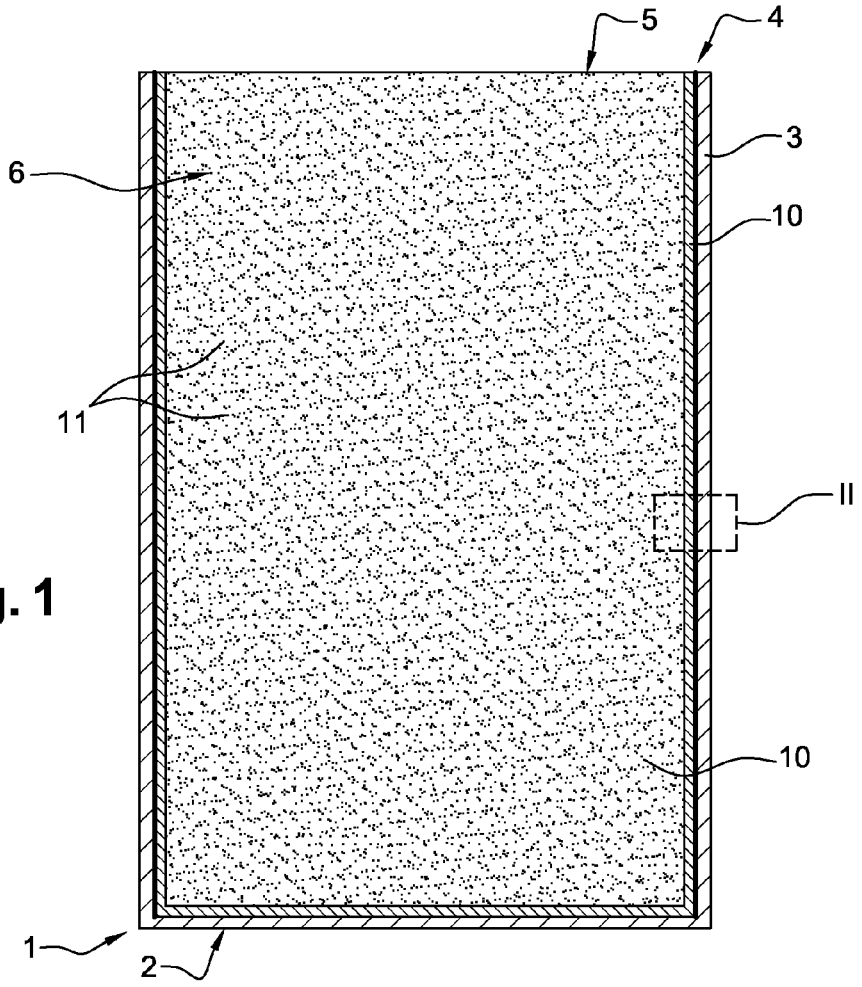
FIG. 1 is a general and schematic view of a container according to the invention, with a vertical diametrical section plane.
Figure 2:
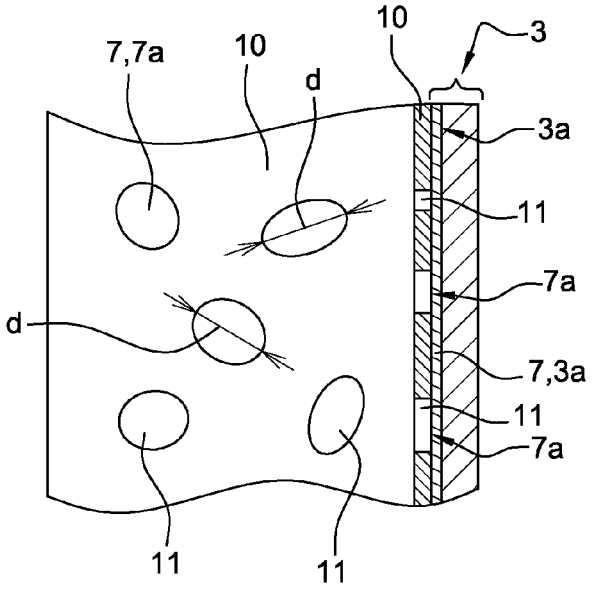
FIG. 2 is an enlarged view of the detail II of FIG. 1, schematically showing the structure of the protective layer covering the container body.

The container according to the invention, as shown in FIGS. 1 and 2, herein consists of a can, for the packaging of, for example, a food item (not shown).

This container comprises a can body 1 consisted of a bottom element 2 whose periphery is continued upward by a side wall 3 (preferably in one or two parts).

The side wall 3 is preferably devoid of beads, or predominantly devoid of such beads.

The upper edge 4 of the side wall 2 delimits an upper opening 5 through which the food item to be packaged is filled. This upper edge 4 is intended to receive a sealing element (not shown), which can be chosen by the one skilled in the art (for example, a pelable membrane or a metal disc with a break-off line).

This can body 1 therefore delimits an inner volume 6 for the packaging of the product of interest (for example, a tomato or fruit-based food product).

The bottom element 2 and the side wall 3 of the can body 1 may be made integral with each other (for example by drawing). These two parts 2, 3 may also be manufactured independently from each other and secured to each other by any suitable operation (for example, by crimping or welding).

The bottom element 2 and the side wall 3 of this can body 1 are advantageously made in a steel die.

Moreover, as illustrated in FIG. 2, at least a portion of the inner surface 7 of this can body 1 (oriented toward the inner volume 6), and preferably at least the inner surface 3*a* of its side wall 3, is made by a tin and/or tin-based alloy coating.

The bottom element 2 may be coated or not with such a tin layer.

The tin inner surface 7 is itself coated with an inner protective layer 10 that is made from a product that resists to the chemical action of the product to be packaged.

The protective layer 10 of the tinned surface 7 includes, distributed over at least a portion of its surface, a plurality of pores 11 through each of which an opposite area 7*a* of the tin inner surface 7 can be accessed from the container inner volume 6.

The bottom element 2 is itself coated with a continuous protective layer 10; as an alternative, this element 2 can be (i) devoid of a protection, (ii) partially protected or (iii) provided with a protective layer 10 also provided with pores 11 (in particular if the bottom element 2 also has an tin inner surface 7).

Such multi-pore protective layer 10, 11 allows the areas 7*a* of the underlying tin inner surface 7 to be placed in contact with the packaged product, so as to release a certain amount of tin within this product by a chemical reaction of the redox type.

Such particular distribution of the exposed tin areas 7*a* has for interest to limit the aesthetic impact thereof (blackening, darkening due to the oxidation by the food item), but also possibly to ensure a well distributed tin release over the whole height of the packaged food item (to provide an at least approximately homogeneous distribution of the tin).

For that purpose, the pores 11 of the protective layer 10 are advantageously uniformly or at least approximately uniformly distributed over the whole tin inner surface 7.

As an alternative, these pores 11 of the protective layer 10 may be distributed and/or grouped only on the side wall 3: over all the height or over only a portion of height of this side wall 3, for example within the width of one or several annular strips.

In the case of a side wall 3 with pores 11 over only a portion of its height, the pores 11 are then advantageously arranged remote from the upper edge 4 and under the surface level of the products packaged in this can body 1; a side wall 3 with an upper strip provided with a uniform protective layer 10 devoid of such ports 11 is thus obtained, which is useful in particular to avoid any negative visual aspect of the protective layer 10.

In all these embodiments, these pores 11 may be distributed and arranged randomly or non-randomly (i.e. in a manner that is determined and predefined so as to form, together, a particular and/or regular pattern).

Still for an optimum compromise between the aesthetics and the desired tin release, the pores 11 have advantageously a maximum size d greater than 0.1 μm, and preferably smaller than 5 mm; these pores 11 have preferably a maximum size d comprised between 10 μm and 2.5 mm.

Also preferably, the pores 11 each have a surface area comprised between 100 $\mu m^2$ and 9 $mm^2$.

As used herein, the "size" of a pore preferably means the greatest size of this pore 11, as illustrated by the size specification d in FIG. 2.

These pores 11 may have a regular or at least approximately regular contour, for example of a generally circular or oval shape, as shown in FIG. 2. As an alternative, this contour may also be irregular.

Moreover, the pores 11 advantageously represent together a surface area comprised between 10% and 70% (preferably between 17% and 50%) of the inner surface of the can body 1, preferably of the inner surface of the side wall 3 and still preferably of the tin inner surface 7.

According to a preferred embodiment, the protective layer 10 advantageously consists of a lacquer layer, the composition and thickness of which, notably, are chosen by the one skilled in the art as a function of the packaged food item.

This protective lacquer is preferably chosen from the polyester and the epoxy-acrylate. It may be applied in liquid or powder form.

Its thickness is advantageously comprised between 2 μm and 80 μm, and still preferably between 4 μm and 30 μm.

The multi-pore protective lacquer layer 10, 11 may be obtained by means of a method comprising, before the step of filling with the product to be packaged, a step of applying the protective layer on the tin inner surface 7 so as to obtain directly said protective layer 10 provided with pores 11.

According to a possible embodiment, the applied protective lacquer consists, for example, of an emulsion or a dispersion comprising (i) the actual protective lacquer and (ii) a fluid (gas or liquid) dispersed within this lacquer and that is capable of being eliminated after the operation of application on the can body 1, so as to form the pores 11 (in practice, this dispersed fluid is advantageously not miscible or a little miscible with the protective lacquer).

In the case of liquid emulsified within the protective lacquer, this liquid is intended to be eliminated by natural or active evaporation. The eliminated liquid consists for example of water.

To adjust the tin release over the height of the can, it may be contemplated to vary the percentage of fluid dispersed within the protective lacquer during the application.

For example, to form the pores 11 remote from the upper edge 4 of the side wall 3 and under the surface level of the products intended to be packaged in the can body 1, it may be provided that:

the protective lacquer applied above the surface level is devoid of the dispersed fluid, and the protective lacquer applied under the surface level contains a suitable amount of this dispersed fluid.

Generally, the protective lacquer may be applied by means of a spray nozzle, a brush, a sponge and/or a roll, such application means being suitably driven in such a manner to obtain the particular protective layer as described above.

According to still another possible embodiment, the protective layer 10 consists of a film integral with the inner surface of the can body 1 and conforming the latter.

This protective film 10 is chosen with a resistance to elongation that is lower than that of the metal material of which said can body 1 is made.

This protective film 10 advantageously consists of a material of the polyethylene terephthalate or polypropylene type.

This protective film 10 may also consist of a lacquer layer having a reduced thickness, for example of the order of 1 to 4 μm, preferably from 1 to 2 μm (or any other type of suitable coating), torn during the shaping operation, so as to generate the desired pores.

In this case, the integral can body 1 of FIG. 1 may be obtained by implementing a method comprising the steps detailed hereinafter, before the step of filling with the product.

Firstly, a metal part is manufactured, the shaping of which will permit to form the can body 1. This metal part is covered with the glued laminated film 10 (or the rather thin protective lacquer layer), intact or entire, which is intended to form the protective layer and which has a resistance to elongation that is lower than that of the metal material of which said metal part is made.

Then, this unit is shaped, for example by drawing, to form the can body 1. This shaping operation generates a partial and local tear of the protective film 10, due to the elongation of the piece 1 in conditions that are higher than the resistance to elongation of the laminated film 10. This drawing operation thus creates a set of pores, cracks or tears 11 acting as orifices for free access to the underlying tin.

Once the can body obtained, with its multi-pore protective layer 10, 11 formed, the container may be filled with the product to be packaged, and the filling opening 5 may then be sealed with a second added bottom element.

As illustrated in FIGS. 1 and 2, the side wall 3 has a generally cylindrical tubular shape; as an alternative, it could have any other desired configuration and section: it could have, for example, an oval, rectangular or square, oblong, radial section, etc.

Likewise, it may include over its height a set of beads or grooves, embossing areas, necking areas, etc.

The container according to the invention has an inner surface that is partially protected. The free areas 7*a* of the tin inner surface 7 are arranged so as to limit the visual impact of the chemical reaction with the packaged product. Moreover, the exposed tin areas 7*a* are herein distributed over the height of the side wall 3, which allows a better release of the tin within the packaged product.

The invention claimed is:

1. A container of the can type, intended to receive a food product to be packaged, said container comprising:

a can body (1) that includes a bottom element (2) that is continued by a side wall (3) with an upper edge (4) that delimits an upper opening (5) intended to receive a sealing element, wherein said can body (1) delimits an inner packaging volume (6) and has an inner surface (7) that is at least partially a tin inner surface (7) covered with a protective layer (10) resistive to the chemical action of said product to be packaged, wherein a plurality of pores (11) are distributed over at least a portion of a surface of the protective layer (10), where through each of the pores (11) an opposite area (7*a*) of said tin inner surface (7) can be accessed from said container inner volume (6), wherein the pores (11) of the protective layer (10) each have a surface area comprised between 100 $\mu m^2$ and 9 $mm^2$, wherein the pores (11) of the protective layer (10) represent together a surface area comprised between 10% and 70% with respect to the inner surface area of the can body (1), and wherein the pores (11) of the protective layer (10) are grouped on a portion of the tin inner surface (7), arranged remote from the upper edge (4) of the side wall (3) and under a surface level of the products intended to be packaged in the can body (1), so as to obtain an upper strip of said side wall (3) provided with a uniform protective layer (10), devoid of the pores (11).

2. The container according to claim 1, wherein at said portion of the tin inner surface (7), arranged remote from the upper edge (4) of the side wall (3) and under a surface level of the products intended to be packaged in the can body (1), the pores (11) of the protective layer (10) are arranged randomly or non-randomly.

3. The container according to claim 1, wherein the pores (11) of the protective layer (10) have a maximum size (d) greater than 0.1 μm.

4. The container according to claim 1, wherein the protective layer (10) is comprised of a protective lacquer.

5. A container according to claim 1, wherein the protective layer (10) is comprised of an integral protective film conforming the inner surface of the can body (1), wherein said protective film (10) has a resistance to elongation that is lower than a resistance to elongation of the metal material of which said can body (1) is made.

6. A method of manufacturing a container that comprises a can body (1) that includes a bottom element (2) that is continued by a side wall (3) with an upper edge (4) that delimits an upper opening (5) intended to receive a sealing element, wherein said can body (1) delimits an inner packaging volume (6) and has an inner surface (7) that is at least partially a tin inner surface (7) covered with a protective layer (10) resistive to the chemical action of said product to be packaged, said method comprising:

before any product filling step, a step of forming on said tin inner surface (7) a protective layer (10) including, distributed over at least a portion of a surface of the protective layer (10), a plurality of pores (11), where through each of the pores (11) an opposite area (7*a*) of said tin inner surface (7) can be accessed from said container inner volume (6), wherein the pores (11) of the protective layer (10) each have a surface area comprised between 100 $\mu m^2$ and 9 $mm^2$, wherein the pores (11) of the protective layer (10) represent together a surface area comprised between 10% and 70% with respect to the inner surface area of the can body (1), and wherein the pores (11) of the protective layer (10) are grouped on a portion of the tin inner surface (7), arranged remote from the upper edge (4) of the side wall (3) and under a surface level of the products intended to be packaged in the can body (1), so as to obtain an upper strip of said side wall (3) provided with a uniform protective layer (10), devoid of the pores (11).

7. The method according to claim 6, wherein said forming step includes applying a protective lacquer on the tin inner surface (7), so that the protective layer (10) is comprised of a protective lacquer that is applied on the tin inner surface (7) so as to obtain, before any product filling step, said protective layer (10) with the pores (11) for access to said tin inner surface (7).

8. The method according to claim 7, wherein the applied protective lacquer is comprised of an emulsion or a dispersion comprising (i) the protective lacquer and (ii) a fluid dispersed within said protective lacquer, and further comprising eliminating the fluid after the step of applying the protective lacquer on the tin inner surface (7), wherein the elimination of the fluid forms the pores (11).

9. The method according to claim 8, wherein the fluid dispersed within the lacquer is comprised of a liquid to be eliminated by evaporation.

10. The method according to claim 6, further comprising, before any product filling step, the steps of:

providing at least one metal part intended to be shaped to form at least a portion of the container can body (1), said metal part being covered with a protective film intended to form the protective layer (10) and having a resistance to elongation that is lower than a resistance to elongation of the metal material from which said metal part is made, and shaping said metal part (1) to form at least a portion of said container can body (1), said shaping operation causing an elongation of said metal part (1), which forms the pores (11) in said protective film (10), by tearing the said protective film (10).

* * * * *